United States Patent [19]

Sato

[11] Patent Number: 4,748,885

[45] Date of Patent: Jun. 7, 1988

[54] ELECTRONIC MUSICAL INSTRUMENT WITH AUTOMATIC RHYTHM GENERATING DEVICE

[75] Inventor: Toshiaki Sato, Hamamatsu, Japan

[73] Assignee: Nippon Gakki Seizo Kabushiki Kaisha, Hamamatsu, Japan

[21] Appl. No.: 937,351

[22] Filed: Dec. 3, 1986

[30] Foreign Application Priority Data

Dec. 7, 1985 [JP] Japan ..... 60-188951[U]

[51] Int. Cl.[4] ..... G10H 1/42; G10H 7/00

[52] U.S. Cl. ..... 84/1.03; 84/1.28; 84/477 R; 84/DIG. 12

[58] Field of Search ..... 84/1.03, 1.28, 477 R, 84/DIG. 12

[56] References Cited

U.S. PATENT DOCUMENTS 3,539,701 11/1970 Milde ..... 84/1.28
3,634,596 1/1972 Rupert ..... 84/1.28
4,326,441 4/1982 Imamura et al. ..... 84/1.03
4,357,854 11/1982 Hirano ..... 84/1.03
4,413,543 11/1983 Iba ..... 84/1.03
4,481,853 11/1984 Ishikawa ..... 84/1.03

*Primary Examiner*—Stanley J. Witkowski
*Attorney, Agent, or Firm*—Blakely, Sokoloff, Taylor & Zafman

[57] ABSTRACT

An electronic musical instrument has a musical tone signal forming circuit, an automatic rhythm generator rhythm selection switches, and a registration memory. The switches are used to select one of a plurality of rhythms. The automatic rhythm generator automatically generates a percussion instrument sound corresponding to a selected rhythm. In the registration memory, musical tone data respectively suitable for selectable rhythms are stored in advance. The musical tone signal forming circuit generates a musical tone signal representing a musical tone and further modifies the musical tone signal in accordance with the musical tone data corresponding to the selected rhythm, whereby a musical tone suitable for the selected rhythm can be generated.

9 Claims, 2 Drawing Sheets

ELECTRONIC MUSICAL INSTRUMENT WITH AUTOMATIC RHYTHM GENERATING DEVICE

BACKGROUND OF THE INVENTION

The present invention relates to an electronic musical instrument having an automatic rhythm generating device.

In conventional electronic musical instruments having automatic rhythm generating devices, a plurality of sets of set/control data for setting and controlling musical tone parameters, such as tone colors and effects, of keyboard play tones are stored in a memory. Any one of a plurality of registration selection switches corresponding to these sets is turned on to read a desired set of set/control data from the memory, so as to set and control musical tone parameters in accordance with the readout set/control data set.

In a conventional electronic musical instrument of this type, parameters such as a tone color and effect can be easily set by operating a registration selection switch. When rhythm tones generated by the automatic rhythm generating device are used as an accompaniment, however, it is not easy to determine which parameters are suitable (i.e., which registration selection switch must be turned on) for the selected rhythm (e.g., swing). In particular, when the player is not accustomed to the instrument, he must usually learn it through trial-and-error process or consult an instructor or the operation manual of the instrument.

Since two types of selections, i.e., rhythm type and registration selections, are needed, operation is cumbersome, and the instrument must have a large number of operation elements arranged on the panel surface.

SUMMARY OF THE INVENTION

It is, therefore, a principal object of the present invention to provide an electronic musical instrument wherein musical tone parameters can be easily set to correspond to a selected rhythm, and the number of operation elements is decreased.

It is another object of the present invention to provide an electronic musical instrument wherein an operation element is multifunctional, thereby improving operability.

According to the present invention, there is provided an electronic musical instrument with an automatic rhythm generating device, comprising: musical tone signal generating means for generating a musical tone signal representing a musical tone to be produced; rhythm name selecting means for selecting one of a plurality of rhythm names; automatic rhythm sound generating means for automatically generating a rhythm sound corresponding to the selected rhythm name; musical tone data generating means for generating one corresponding to the selected rhythm name among a plurality of musical tone data each of which determines a characteristic of the musical tone; and modifying means for modifying the musical tone signal in accordance with the generated musical tone data, so that a musical tone suitable for a selected rhythm name can be generated.

DESCRIPTION OF THE PREFERRED EMBODIMENT

Figure 1:
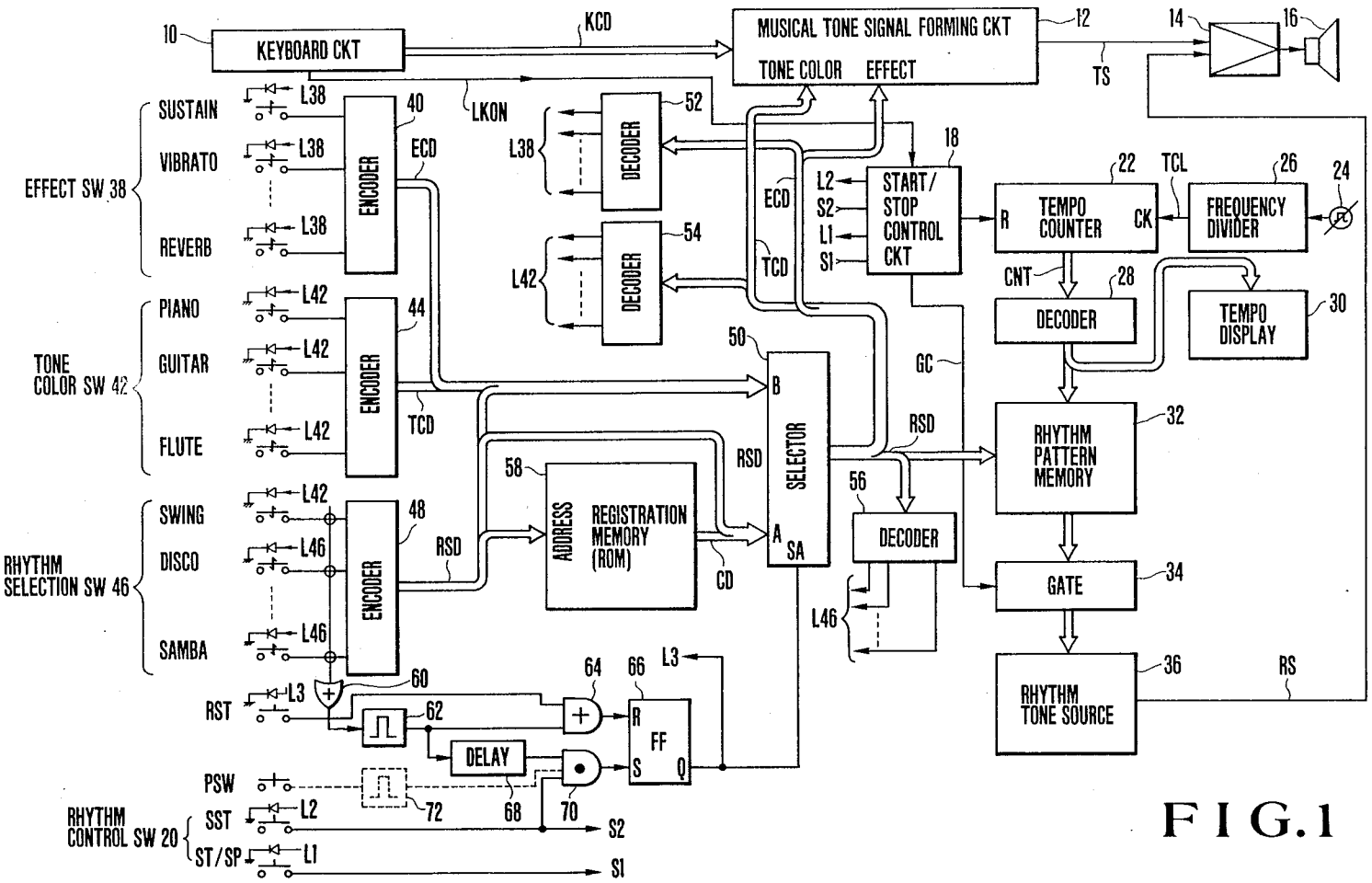
FIG. 1 is a circuit diagram showing a configuration of an electronic musical instrument according to an embodiment of the present invention.

FIG. 1 is a circuit diagram showing a configuration of an electronic musical instrument according to an embodiment of the present invention. This electronic musical instrument includes a keyboard tone generating section, an automatic rhythm play section, and a play control section, to be described as follows.

Keyboard Tone Generating Section

A keyboard circuit 10 has a keyboard with upper and lower key ranges for melody and accompaniment, respectively. When a key of the keyboard is depressed, the keyboard circuit 10 generates key code data KCD identifying the depressed key. When any key in the lower key range is depressed, the keyboard circuit 10 generates a key on signal LKON.

A musical tone signal forming circuit 12 forms a musical tone signal corresponding to a depressed key in accordance with key code data KCD supplied from the keyboard circuit 10. The tone color and effect of the musical tone signal are set and controlled in accordance with tone color and effect set/control data TCD and ECD, respectively.

A musical tone signal TS supplied from the musical tone signal forming circuit 12 is supplied to a loudspeaker 16 through an output amplifier 14 and is converted into a sound.

Automatic Rhythm Generating Section

A start/stop control circuit 18 controls start/stop of an automatic rhythm play. The start/stop control circuit 18 receives the key on signal LKON from the keyboard circuit 10, and switch state signals S1 and S2 from a start/stop switch ST/SP as a rhythm control switch (SW) 20 and a synchro start switch SST, respectively.

When the start/stop switch ST/SP is turned on, the control circuit 18 breaks a reset state of a tempo counter 22 in accordance with a corresponding switch state signal S1 and sets a gate control signal GC at level "1". Automatic rhythm play is thus started. When the start/-stop switch ST/SP is turned on again, the control circuit 18 resets the tempo counter 22 and sets the gate control signal GC at level "0". The automatic rhythm play is thus stopped. The control circuit 18 turns on a light-emitting diode in the vicinity of the switch ST/SP by a drive signal L1 during the automatic rhythm play, thereby indicating that automatic rhythm play is in progress.

When the synchro start switch SST is turned on, the control circuit 18 generates a drive signal L2 in accordance with a corresponding switch state signal S2 and turns on a light-emitting diode in the vicinity of the switch SST, thereby indicating a synchro wait state. In the synchro wait state, when a key on signal LKON is supplied to the control circuit 18, the control circuit 18 stops signal supply to an R terminal of the tempo counter 22 to set it, and sets the gate control signal GC to level "1", thereby starting an automatic rhythm play. In this case, the drive signal L2 is stopped, and the light-emitting diode in the vicinity of the switch SST is turned off. Thereafter, when the automatic rhythm play is to be stopped, the start/stop switch ST/SP is turned on. Then, the automatic rhythm play is stopped in the same manner as described above.

A clock signal supplied from a frequency-variable clock generator 24 is supplied as a tempo clock signal TCL to a CK terminal of the tempo counter 22 through a frequency divider 26. When the tempo counter 22 is set, as described above, it counts the tempo clock signal TCL from the frequency divider 26, and outputs a count output CNT. The counting operation of the tempo counter 22 is repeated, e.g., every two measures.

A decoder 28 decodes the count output CNT from the tempo counter 22 and outputs a decoded output to a tempo display 30 and a rhythm pattern memory 32.

The tempo display 30 displays a tempo of a rhythm by, e.g., sequentially turning on a plurality of light-emitting elements in accordance with the decoded output from the decoder 28.

The rhythm pattern memory 32 stores rhythm patterns in units of rhythm types, such as swing, disco, . . . , samba, and so on, and repeatedly reads out a rhythm pattern specified by rhythm selection data RSD in accordance with the output from the decoder 28.

The readout output from the rhythm pattern memory 32 is supplied to a gate circuit 34. The gate circuit 34 is enabled or disabled when the gate control signal GC from the start/stop control circuit 18 is set at level "1" or "0", respectively, as described above.

When the gate circuit 34 is enabled, the readout output from the rhythm pattern memory 32 is supplied to a rhythm tone source circuit 36. The rhythm tone source circuit 36 forms a rhythm tone signal by selectively driving various types of percussion instrument sound sources, e.g., a bass drum, a snare drum, a cymbal, a maraca, and so on, in accordance with the readout rhythm pattern. A rhythm tone signal RS from the rhythm tone source circuit 36 is supplied to the loudspeaker 16 through the output amplifier 14 and is converted into a sound.

Play Control Section

Effect switches 38 for controlling ON/OFF of effects, such as sustain, vibrato, reverbation, and so on, are provided. Light-emitting diodes are provided in the vicinity of the corresponding switches 38. The effect switches 38 are lock-type switches. When a switch 38 is depressed once, it is locked; when it is depressed again, it is reset.

An encoder 40 receives and encodes a state signal of each effect signal 38 and outputs effect set/control data ECD as an encoded output.

Tone color switches 42 for selecting a tone color of, e.g., a piano, a guitar, a flute, and so on, are provided. Light-emitting diodes are provided in the vicinity of the corresponding switches 42. The tone color switches 42 are lock-type switches and can be depressed only alternatively (more than one tone color switches 42 cannot be depressed at once).

An encoder 44 receives and encodes a state signal of each tone color switch 42 and outputs tone color set/-control data TCD as an encoded output.

Rhythm selection switches 46 for selecting a rhythm type, e.g., swing, disco, samba, and so on, are provided. Light-emitting diodes are provided in the vicinity of the corresponding selection switches 46. The rhythm selection switches 46 are lock-type switches and can be depressed only alternatively.

An encoder 48 receives and encodes a state signal of each rhythm selection switch 46 and outputs rhythm selection data RSD as an encoded output.

The effect set/control, tone color set/control, and rhythm selection data ECD, TCD, and RSD are supplied to a selector 50 as an input B. The selector 50 selects the input B or A when its control input SA is set at level "0" or "1", respectively.

When the selector 50 selects the input B, the effect set/control, tone color set/control, and rhythm selection data ECD, TCD, and RSD are supplied to the musical tone signal forming circuit 12 and 52, to the musical tone signal forming circuit 12 and the decoder 54, and to the rhythm pattern memory 32 and a decoder 56, respectively.

A decoder 52 decodes the effect set/control data ECD to obtain an output L38, thereby controlling ON/OFF of the light-emitting diodes corresponding to the respective effect switches 38. A decoder 54 decodes the tone color set/control data TCD to obtain an.output L42, thereby controlling ON/OFF of the light-emitting diodes corresponding to the respective tone color switches 42. The decoder 56 decodes the rhythm selection data RSD to obtain an output L46, thereby controlling ON/OFF of the light-emitting diodes corresponding to the rhythm selection switches 46. With such ON/OFF control, when, e.g., a switch corresponding to "sustain" is turned on, a corresponding light-emitting diode is turned on. When a switch corresponding to "piano" is turned on, a corresponding light-emitting diode is turned on. When a switch corresponding to "swing" is turned on, a corresponding light-emitting diode is turned on.

A registration memory 58 comprises, e.g., a ROM (Read Only Memory), and stores set/control data which are set at the factory to correspond to the effects and tone colors described above in units of rhythm types as enumerated above. The memory 58 receives the rhythm selection data RSD from the encoder 48 as an address input, and outputs set/control data CD corresponding to the rhythm type specified by the rhythm selection data RSD.

The set/control data CD read out from the memory 58 is supplied to the selector 50 as an input A together with the rhythm selection data RSD.

When the selector 50 selects the input A, the rhythm selection data RSD is supplied to the rhythm pattern memory 32 and the decoder 56. Among the set/control data CD, the effect and tone color set/control data ECD and TCD are supplied to the musical tone signal forming circuit 12 and the decoder 52, and to the musical tone signal forming circuit 12 and the decoder 54, respectively. As a result, the decoders 52, 54, and 56 perform ON/OFF control the same as that described above.

The selector 50 selects the input A when any one of the rhythm selection switches 46 and the synchro start switch SST are turned on at once. More specifically, when any one of the rhythm selection switches 46 is turned on, an output from an OR gate 60 is set at level "1", and a leading-edge differentiator 62 generates a differentiation output pulse in accordance therewith. The differentiation output pulse momentarily resets an R-S flip-flop 66 through an OR gate 64, and at the same time is supplied to an AND gate 70 with a slight delay through a delay circuit 68. In this case, the AND gate 70 has been enabled in response to the ON operation of the synchro start switch SST. Therefore, the differentiation output pulse from the delay circuit 68 sets the flip-flop 66 through the AND gate 70. The control input SA to the selector 50, which corresponds to an output Q of the flip-flop 66, is set at level "1", and the selector 50 selects the input A. The rhythm type selection by the rhythm selection switches 46, and set/control of the tone color and effect in accordance with the data read out from the memory 58, are thus enabled. In order to facilitate simultaneous operation of the both rhythm selection switches 46 and the synchro start switch SST, they may be arranged closely so that they can be operated by one hand.

The output Q="1" of the flip-flop 66 turns on a light-emitting diode in the vicinity of a reset switch RST as a drive signal L3. The player can see whether a tone color and effect are set only by watching this light-emitting diode.

Assume that the player has finished playing a certain piece and is to start a next one. When the reset switch RST is turned on, the flip-flop 66 is reset in response to an output of level "1" from the OR gate 64. Therefore, the output Q from the flip-flop 66 is set at level "0", and the selector 50 selects the input B. The light-emitting diode in the vicinity of the reset switch RST which receives the output L3 from the flip-flop 66 is turned off. In this state, rhythm type selection by the rhythm selection switches 46 and set/control of a tone color and effect by the effect switches 38 are enabled. It must be noted that the selector 50 can select the input B even during a play of a piece.

Modifications

In the above embodiment, the selector 50 selects the input A when one of the rhythm selection switches 46 and the synchro start switch SST are operated simultaneously. However, the selector 50 can select the input A when a power source switch PSW, in place of the synchro start switch SST, and one of the rhythm selection switches 46 are operated simultaneously. For this purpose, a signal obtained by differentiating the leading edge of an on signal from the power source switch PSW may be differentiated by the differentiator 72 and supplied to the AND gate 70, as indicated by a broken line in FIG. 1, in place of the state signal of the synchro start switch SST.

The synchro start switch or power source switch can be operated simultaneously with the rhythm selection switch, as described above. However, e.g., an arbitrary key of the keyboard, a knee lever, a foot switch of an expression pedal, a normal switch of an auto bass code, or the like can be operated instead simultaneously with the rhythm selection switch.

In the above embodiment, the selector selects the input A when one of the rhythm selection switches 46 and another specific operation element are operated at once. However, a mode selection switch for switching between manual and memory modes may be provided. In this case, when the manual mode is selected with this selection switch, the selector 50 may select the input B; when the memory mode is selected, the selector 50 may select the input A. In this case, the flip-flop 66 and a circuit associated therewith are not needed. When the memory mode is selected, every time an arbitrary rhythm type is selected, a tone color and effect suitable for the selected rhythm type can be set. This is particularly effective when a rhythm type is to be changed from, e.g., "swing I" to "swing II" during play of a piece.

In the above embodiment, the registration memory 58 comprises a ROM. However, the registration memory 58 can comprise a RAM (Random Access Memory). In this case, the content of the set/control data set in the RAM can be partially changed by means of the effect or tone color switches 38 or 42, or the like.

In the above embodiment, a single desired tone color is set for tones of the whole keyboard. However, assuming that, e.g., swing rhythm is selected, tone colors of the saxophone, brass, jazz guitar, and electric guitar can be set for the solo organ, upper range keyboard, lower range keyboard, and pedal keyboard, respectively. In this case, when the rhythm type is changed, the tone color combination can be changed.

The data to be stored in the registration memory 58 is not limited to those as described above, but can include data on an auto bass code, rhythm tempo, volume, and so on. These data can be read out and are set/controlled. In this case, when the data read out from the memory is not used, the auto bass code, rhythm tempo, volume, and so on can be manually set.

The rhythm pattern memory 32 can comprise a ROM, and the user can program arbitrary rhythm patterns in it and select a desired rhythm pattern.

Figure 2:
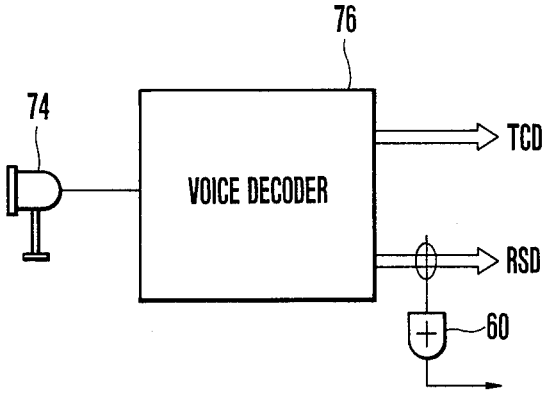
FIG. 2 is a circuit diagram showing a modification of a rhythm selection means.

In the above embodiment, rhythm selection operation elements are used as rhythm selecting means. The player operates the elements to select a desired rhythm. However, a voice recognition unit comprising a sound-signal converter 74 and a voice decoder 76, as shown in FIG. 2, can be used in place of the rhythm selection operation elements. In this modification, when the player orally says "swing", "disco", or the like instead of depressing a rhythm selection operation element, the voice recognition unit recognizes the voice and outputs a selection signal RSD, thereby selecting a rhythm type. Regarding tone color selection, if the player orally specifies a rhythm type, the voice recognition unit can also recognize his voice, determine the tone color, and output a selection signal TCD, thereby selecting a tone color. Therefore, if the player says the name of rhythm and operates a specific operation element such as a synchro start switch, musical tone parameters can be set in the same manner as in the above embodiment.

In this manner, according to the present invention, musical tone parameters can be set in accordance with a rhythm type selection by means of a rhythm selection means. Therefore, a tone color, effect, and the like of the keyboard sound matching the selected rhythm can be set easily, and the number of the operation elements can be decreased since the registration selection operation elements are not needed.

In the embodiment described above, it is detected that rhythm type selection by means of a rhythm selection means and operation of a specific operation element other than the rhythm selection means are performed simultaneously, and musical tone parameters based on data read out from the memory are set and controlled. Therefore, when such a simultaneous operation is not performed, rhythm type selection by the rhythm selection means and musical tone parameter setting by a manual operation can be performed, thereby omitting a mode selection switch. In this case, the operability is still more improved if a switch, such as a power source switch which is always operated prior to the start of a play without failure, or a switch, such as a synchro start switch which tends to be often operated prior to the start of a play, is used as the specific operation element.

What is claimed is:

1. An electronic musical instrument with an automatic rhythm generating device, comprising:

musical tone signal generating means for generating a musical tone signal representing a musical tone to be produced;

rhythm name selecting means for selecting one of a plurality of rhythm names;

automatic rhythm sound generating means for automatically generating a rhythm sound corresponding to the selected rhythm name;

musical tone data generating means for generating musical tone data corresponding to said selected rhythm name among a plurality of musical tone data each of which determines a characteristic of said musical tone; and modifying means for modifying said musical tone signal in accordance with the generated musical tone data, so that a musical tone suitable for a selected rhythm name can be generated.

2. An instrument according to claim 1, further comprising manual operating means for causing said automatic rhythm sound generating means to start generating a rhythm tone.

3. An instrument according to claim 2, further comprising prohibiting means for prohibiting supply of said generated musical tone data to said musical tone data generating means in response to an operation of said manual operating means and supplying another musical tone data different from said generated musical tone data to said musical tone data generating means.

4. An instrument according to claim 1, further comprising:

a keyboard having a plurality of keys; and synchro start means for causing said automatic rhythm sound generating means to start producing the rhythm sound in synchronism with a first key operation on said keyboard, wherein said musical tone data generating means generates a musical tone signal having a pitch specified by a depressed key among said plurality of keys.

5. An instrument according to claim 2, wherein said manual operating means has also a function to turn on/off a power source.

6. An instrument according to claim 1, wherein said rhythm name selecting means has display means for displaying what the selected rhythm name is.

7. An instrument according to claim 1, wherein said rhythm name selecting means comprises a voice decoder for identifying the selected rhythm name from a voice of an operator.

8. An instrument according to claim 1, wherein said rhythm name selecting means has rhythm name information generating means for generating rhythm name information corresponding to said selected rhythm name.

9. An instrument according to claim 1, wherein said musical tone data generating means has musical tone data storing means for storing said plurality of musical tone data.

* * * * *